US005217054A

United States Patent [19]

Mollica

[11] Patent Number: 5,217,054

[45] Date of Patent: Jun. 8, 1993

[54] ACTUATOR FOR A TRIGGER OF AN AUTOMATIC NOZZLE OF A GAS PUMP

[76] Inventor: Kathleen Mollica, 307 Jefferson St., Verona, Pa. 15147

[21] Appl. No.: 941,204

[22] Filed: Sep. 4, 1992

[51] Int. Cl.[5] ..... B65B 1/04; B65B 3/00

[52] U.S. Cl. ..... 141/391; 141/392; 74/526

[58] Field of Search ..... 141/391, 392, 206, 207, 141/208, 209; 251/90, 93, 294; 74/526

[56] References Cited

U.S. PATENT DOCUMENTS

| | | | |
|---|---|---|---|
| D. 326,462 | 5/1992 | Cooper | 141/392 |
| 4,201,253 | 5/1980 | Maloney | 251/90 |
| 4,245,682 | 1/1981 | Agnew, Sr. | 141/392 |
| 4,275,776 | 6/1981 | Rehkopf | 141/392 |
| 4,278,116 | 7/1981 | Opp | 141/392 |
| 4,722,375 | 2/1988 | Fox | 141/392 |
| 4,802,516 | 2/1989 | Dahlem | 141/392 |

*Primary Examiner*—Henry J. Recla
*Assistant Examiner*—Steven D. Douglas
*Attorney, Agent, or Firm*—William J. Ruano

[57] ABSTRACT

In combination with an automatic nozzle of a gasoline pump, the nozzle having a trigger operable within a housing which includes a trigger guard; an actuator for the trigger in the form of a spring extending transversely of and supported on the trigger guard and engaging the trigger.

5 Claims, 3 Drawing Sheets

ACTUATOR FOR A TRIGGER OF AN AUTOMATIC NOZZLE OF A GAS PUMP

BACKGROUND OF THE INVENTION

A filling nozzle with an automatic shut-off is well known as shown as early as the Davis U.S. Pat. No. 2,320,033 dated May 25, 1943 and Duerr U.S. Pat. No. 2,582,195 dated Jan. 8, 1952. Numerous gasoline pumps have been provided to include regulator clips for holding the triggers of the nozzles in operable position to avoid the necessity of squeezing the triggers by hand by customers. Attempts have been made in the past to overcome this disadvantage by providing a web suspended on the trigger containing housing, which web has a lower jaw mounting a leaf spring, such as shown in Hanna U.S. Pat. No. 4,846,447 dated Jul. 11, 1989. Such web is permanently suspended and an unstable part of the pump housing and such leaf spring has very limited springiness as not to be reliable in operation.

SUMMARY OF THE INVENTION

An object of the present invention is to overcome the abovementioned disadvantages by providing a much simpler and inexpensive structure in the form of a looped spring which is so mounted in the pump housing as to take the place of both the abovementioned web and leaf spring and which is more stable and reliable in operation.

Another object of the invention is to provide a looped spring which can be carried by a customer or given to him at a service station if the customer desires to do other things such as wash car windows, inflate tires etc. while the gas tank is being filled up with an automatic cut off when the tank is filled. Also, it is very advantageous to the elderly, the handicapped and those with respiratory problems.

Still another object is to provide a looped spring of such shape as to be usable at various gas stations having nozzles including trigger guards of different widths.

DESCRIPTION OF THE PREFERRED EMBODIMENTS

Figure 1:
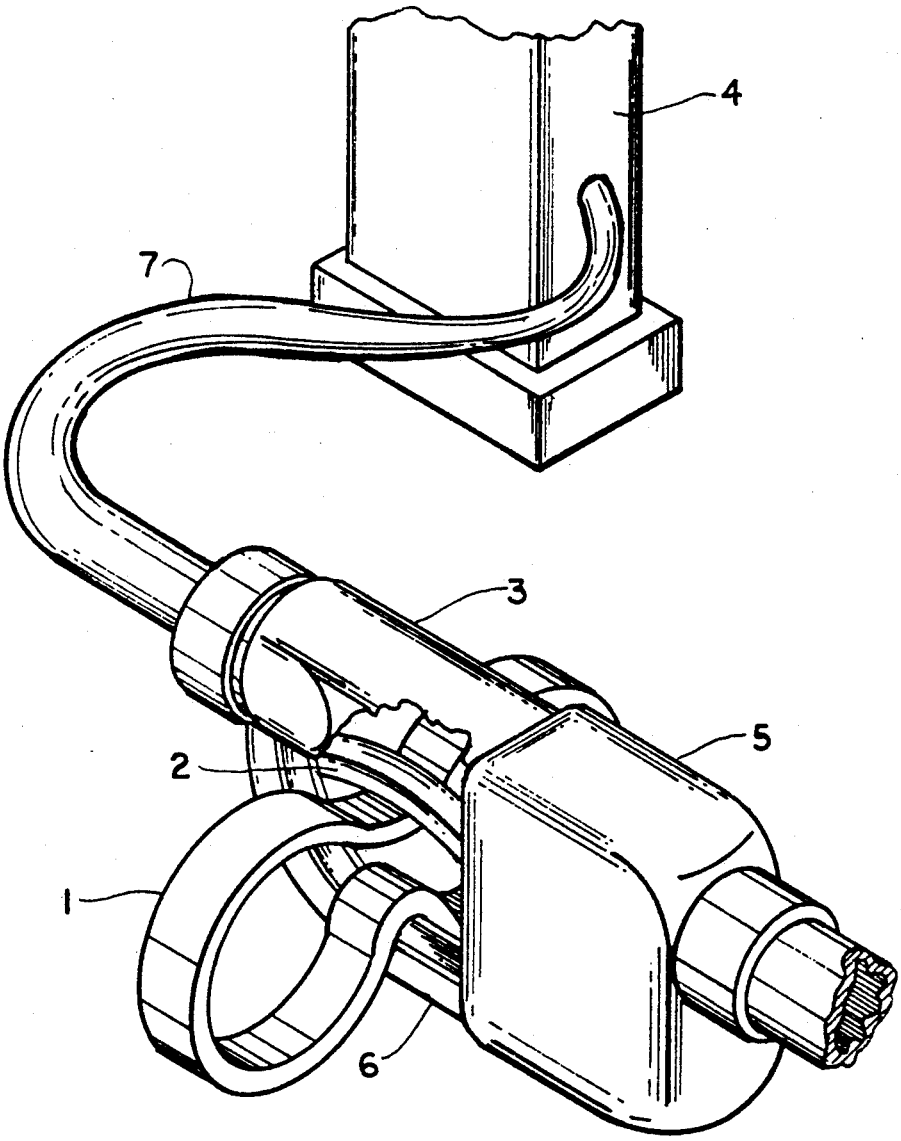
FIG. 1 is a perspective view with parts broken away of a gasoline pump with an automatic nozzle and the invention being applied thereto for operating the trigger thereof.

FIG. 1 illustrates an actuator 1, embodying the present invention for a trigger 2 of an automatic nozzle 3 of a gasoline pump 4. The nozzle 3 has a trigger 2 operable within a housing 5.

Figure 2:
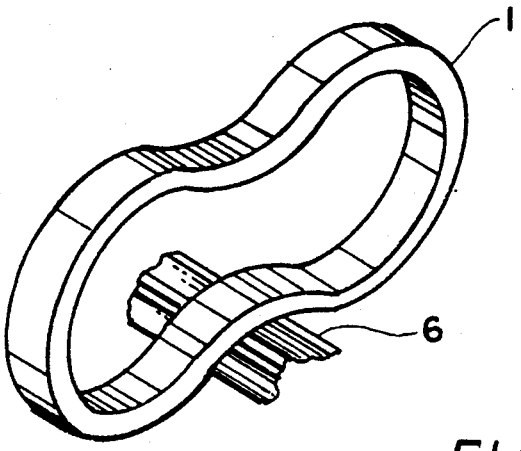
FIG. 2 is a perspective view of the invention.

The spring 1, as best shown in FIG. 2, is in the form of a loop with its center portions closer together than its end portions. The top central portion of the spring 1 supports the trigger 2 while the bottom central portion of spring 1 rests on the trigger guard 6. Thus when the automobile tank is filled through hose 7, or when set number of gallons of gasoline desired has been obtained, the trigger 2 will move downwardly against the top of spring 1, after which the flow of gasoline from the pump 4 to housing 5 ceases.

Figure 3:
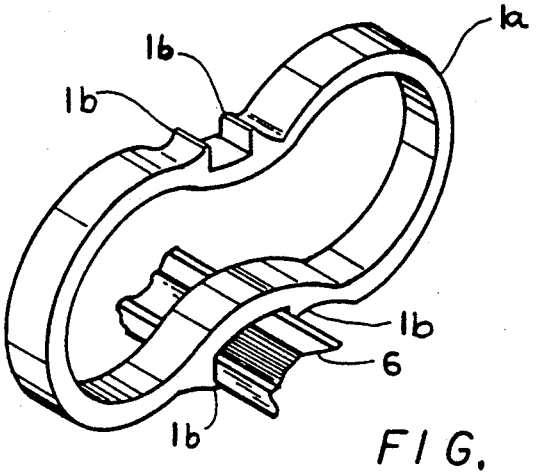
FIG. 3 is a perspective view of a second modification of the invention.

FIG. 3 shows a modification of the spring 1*a* in a form having outstanding projections 1*b* and 1*c* which rest against the sides of the trigger guard 6 to enhance stability. The spring may be of metal or plastic material.

Figure 4:
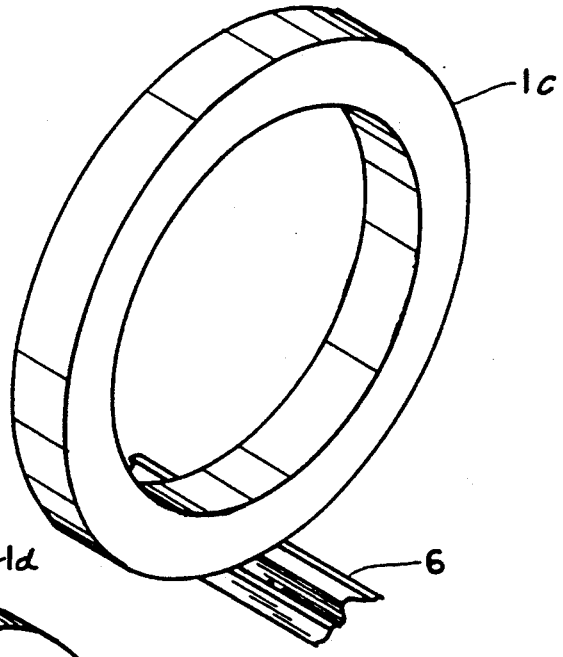
FIG. 4 is a perspective view of a third modification of the invention.

FIG. 4 shows a still further modification of the spring 1 in the form of a circle 1*c*.

Figure 5:
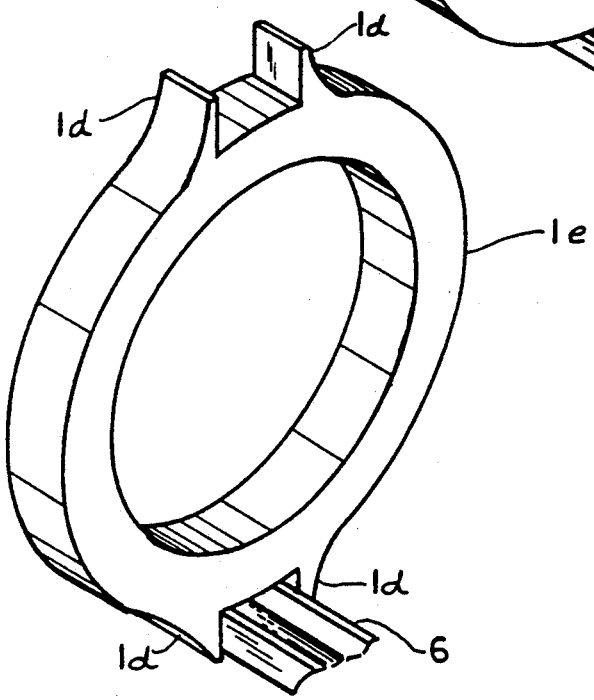
FIG. 5 is a perspective view of a fourth modification of the invention.

FIG. 5 shows a further modification of FIG. 4 having outstanding projections 1*d*, 1*d* and a circular portion 1*e*.

Figure 6:
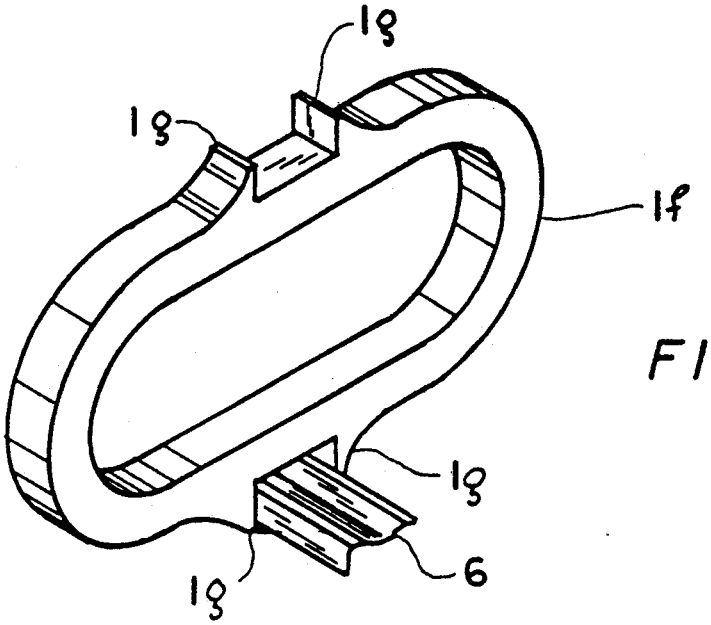
FIG. 6 is a perspective view of a fifth modification of the invention.
Figure 7:
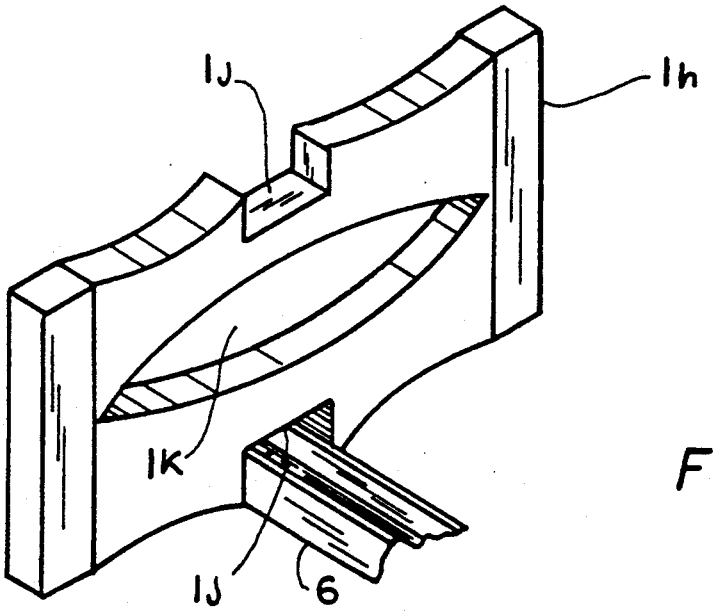
FIG. 7 is a perspective view of a sixth modification of the invention.

FIG. 6 shows a modification of FIG. 3 having two pairs of outstanding projections 1*g*, 1*g* and a somewhat elliptical portion 1*f*; and FIG. 7 shows a still further modification 1*h* having cut-out portions 1*j*, 1*j*, a rectangular portion 1*h* and a central opening 1*k*.

I claim:

1. In combination with an automatic nozzle of a gasoline pump, the nozzle having a trigger pivotally mounted on a housing to pivot in a plane, said housing includes a trigger guard lying in said plane around said trigger; a flexible actuator for said trigger in the form of a closed loop spring extending transversely of and centrally supported between said trigger guard and said trigger; and wherein said closed loop spring is elliptically shaped and has central portions along the minor axis thereof and wherein said trigger guard is of U-shaped cross section with the legs of the U-extending toward said trigger.

2. An actuator as recited in claim 1 wherein said central portions have integral outward projections for engaging the sides of said trigger guard.

3. An actuator as recited in claim 2 wherein said outward projections are spaced slightly greater than the width of said trigger guard.

4. An actuator as recited in claim 1 made of plastic material.

5. An actuator as recited in claim 1 wherein said spring is circular and engages the inner sides of said legs of said trigger guard.

* * * * *